US011643605B2

(12) United States Patent
Snow et al.

(10) Patent No.: US 11,643,605 B2
(45) Date of Patent: May 9, 2023

(54) RADIOFREQUENCY PUMP INLET ELECTRIC HEATER

(71) Applicant: PyroPhase, Inc., Chicago, IL (US)

(72) Inventors: Richard H. Snow, Chicago, IL (US); C. Dino Pappas, Skokie, IL (US)

(73) Assignee: PYROPHASE, INC., Chicago, IL (US)

( * ) Notice: Subject to any disclaimer, the term of this patent is extended or adjusted under 35 U.S.C. 154(b) by 734 days.

(21) Appl. No.: 16/570,738

(22) Filed: Sep. 13, 2019

(65) Prior Publication Data

US 2020/0087583 A1 Mar. 19, 2020

Related U.S. Application Data

(60) Provisional application No. 62/733,208, filed on Sep. 19, 2018.

(51) Int. Cl.
*H05B 6/80* (2006.01)
*H05B 6/10* (2006.01)
(Continued)

(52) U.S. Cl.
CPC ..... *C10G 31/06* (2013.01); *C10G 1/00* (2013.01); *C10G 75/00* (2013.01); *E21B 43/2401* (2013.01); *H05B 6/60* (2013.01); *H05B 6/802* (2013.01); *C10G 2300/206* (2013.01); *C10G 2300/208* (2013.01); *C10G 2300/302* (2013.01); *C10G 2300/4075* (2013.01); *H05B 2214/03* (2013.01)

(58) Field of Classification Search
CPC ..... C10G 1/00; C10G 2300/206; C10G 2300/208; C10G 2300/302; C10G 2300/4075; C10G 31/06; C10G 75/00; E21B 43/2401; H05B 2214/03; H05B 6/60; H05B 6/62; H05B 6/802
USPC ..... 219/687, 640, 686, 688, 689, 696, 697, 219/745, 746, 748, 749, 750, 695, 691, 219/759.778, 772; 166/248, 52, 53, 60, 166/66.5, 271, 245, 272.1
See application file for complete search history.

(56) References Cited

U.S. PATENT DOCUMENTS 4,140,179 A * 2/1979 Kasevich ..... E21B 36/04 166/248
4,140,180 A 2/1979 Bridges et al.
(Continued)

FOREIGN PATENT DOCUMENTS

CN 2276555 3/1998
WO WO 2018/100545 6/2018

OTHER PUBLICATIONS

International Search Report and Written Opinion in related PCT Application Serial No. PCT/US2019/051726 dated Jan. 14, 2020, 15 pages.

(Continued)

*Primary Examiner* — Quang T Van
(74) *Attorney, Agent, or Firm* — McCracken & Gillen LLC

(57) ABSTRACT

The present invention reduces viscosity of highly viscous materials before entering a pump inlet by applying radio-frequency heating to the volume of material in a cage of rods that serve as electrodes surrounding a perforated inlet conduit. Applications include heavy hydrocarbonaceous materials such as tar and pitch in reservoirs, and sludge accumulating within oil storage tanks, ships, and barges. A mixer can be added to aid the process.

10 Claims, 10 Drawing Sheets

(51) Int. Cl.

| | |
|---|---|
| ***C10G 31/06*** | (2006.01) |
| ***C10G 1/00*** | (2006.01) |
| ***C10G 75/00*** | (2006.01) |
| ***E21B 43/24*** | (2006.01) |
| ***H05B 6/60*** | (2006.01) |

(56) References Cited

U.S. PATENT DOCUMENTS

| | | | | |
|---|---|---|---|---|
| 4,196,329 | A | 4/1980 | Rowland et al. | |
| RE30,738 | E | 9/1981 | Bridges et al. | |
| 4,320,801 | A | 3/1982 | Rowland et al. | |
| 4,485,869 | A * | 12/1984 | Sresty ..... | E21B 43/2401 166/263 |
| 5,055,180 | A | 10/1991 | Klaila | |
| 5,293,936 | A | 3/1994 | Bridges | |
| 8,210,256 | B2 | 7/2012 | Bridges | |
| 8,408,294 | B2 | 4/2013 | Bridges | |
| 9,464,513 | B2 | 10/2016 | McConaghy et al. | |
| 9,777,564 | B2 | 10/2017 | Snow et al. | |
| 2009/0071646 | A1 | 3/2009 | Pankratz et al. | |
| 2012/0325459 | A1 | 12/2012 | Bridges | |
| 2015/0377001 | A1 | 12/2015 | Parsche | |

OTHER PUBLICATIONS

Extended European Search Report issued in related EP Application No. 19863072.5, 8 pages, dated Apr. 21, 2022.

* cited by examiner

SECTION B-B

RADIOFREQUENCY PUMP INLET ELECTRIC HEATER

CROSS REFERENCE TO RELATED APPLICATIONS

The present application claims the benefit of U.S. Provisional Application Ser. No. 62/733,208, filed Sep. 19, 2018, entitled "Radio-Frequency Pump Inlet Electric Heater". The entire contents of this application are incorporated herein by reference.

FIELD OF THE INVENTION

This invention relates to the handling of highly viscous hydrocarbon containing materials. More particularly this invention relates to equipment and methods for extracting and pumping heavy hydrocarbons having a high viscosity such as bitumen or other semi-fluid crude oils.

BACKGROUND OF THE INVENTION

Heavy hydro-carbonaceous materials, such as the bitumen from oil sands, asphalt, tars, pitch and other highly viscous hydrocarbons have a wide variety of uses in either native form or after treatment to reduce their viscosity. Further sources comprise heavy oils ranging from naturally heavy and viscous crude oils to sludge formed by precipitation of heavier molecules during long-term storage of oil in tanks or other vessels. (The term HCM as used herein refers to all such heavy hydro-carbonaceous materials.) Various upgrading methods are known for treating such materials to reduce their viscosity and produce lower molecular weight hydrocarbons. These methods typically treat the HCM in-situ or in facilities located apart from the source of the HCM i.e. remote treatment process.

Asphalt and tar are examples of HCMs that can undergo upgrading in a refinery or other facilities but can also find use in their substantially native form. Natural asphalt or tar deposits exist in many locations. A tar pit, or more accurately an asphalt lake or pitch lake, is the result of a type of petroleum seepage where subterranean bitumen leaks to the surface, creating a large area of natural asphalt. These deposits result when heavy hydro-carbonaceous material reaches the surface, its lighter components vaporize, thereby leaving only the thick asphalt.

These deposits can cover large areas ranging from a few acres to thousands of acres. Specific sites of natural asphalt occur in many geographic areas. Up until 1935 Guanoco Lake (also known as Bermúdez Lake) in Venezuela provided an extensive commercial site for producing such material and still covers more than 445 hectares (1,100 acres) and contains an estimated 6,000,000 tons of asphalt. Other deposits occur commonly where Paleogene and Neogene marine sediments outcrop on the surface; the tar pits at Rancho La Brea in Los Angeles are an example of such a formation. Although most pitch lakes are fossils of formerly active seepage, some, such as Pitch Lake on the island of Trinidad, continue to receive fresh crude oil that seeps from a subterranean source. Pitch Lake covers 47 hectares (115 acres) and contains an estimated 6,700,000 tons of asphalt. The asphalt provides Trinidad and Tobago with a major export for road building.

Whether for use in substantially native form or in producing upgraded products, utilization of HCMs requires handling in the form of collection and transport. Using remote treatment processes requires transport of the HCM from the source to treatment facilities. Initial collection of HCMs such as asphalt, whether used for road paving or as a refinery feed, first requires its collection by pumping or digging and usually delivery to a loading terminal. The viscosity of the tar or asphalt render such mechanical means cumbersome because the tar's stickiness which tends to clog equipment. Surface collection of tar brings with it soil, rock and water contamination that exacerbates equipment problems and reduces the value and/or utility of the collected tar. These problems have impeded or added to the cost of putting tar to useful purposes.

Pumping presents a highly desirable means for HCM collection and transport. Unfortunately, the high viscosity of HCMs hinders the use of pumps for its transport through pipes and other conduits. Filling the pump with the HCM poses the primary problem. If a pump could fill with the HCM it generally would have sufficient power and thrust to push the HCM further along the discharge pipe. But no matter how much power is applied, only suction can pull the HCM oil into the pump. However, the high viscosity usually creates a vacuum that causes bubble formation often resulting in cavitation at the pump. Bubble formation, i.e. cavitation denies the pump any material upon which to exert its thrust and leaves the pump suction line with a bottleneck. Similar related problems arise when trying to draw viscous asphalt from a tar pit via a suction line as well as pumping HCM from a tank.

Heating of the pump inlet pipe, by any means, would lower the oil viscosity, but that would only move the bottleneck back to the inlet of the suction line or to whatever point the heating stops. Traditional electric resistance heaters such as cartridge heaters depend on slow thermal conduction from a heater through stationary oil, which is too viscous for convection to help.

The vast surface area may also require the removal of the HCM from many different locations over the surface of the deposit. Locating and relocating a suction inlet that can also supply heat for HCM removal poses another problem in its recovery and handling.

A related problem arises in petroleum storage tanks. When oil is stored in such tanks over periods of years, some of the heaviest components separate and form HCM sludge at the bottom of the tank. Removing the sludge by mechanical means involves hand labor, is dangerous work and is expensive. For example, a typical 200 foot in diameter storage tank that builds up 8 eight feet of sludge loses about 250,000 cubic feet of storage capacity which typically equals an overall storage capacity loss of 25 or 35%. Similar problems arise in in the shipment of oil in rail cars, ships, and barges. A reliable and efficient pump and pumping method for removing such deposits would have great value.

Accordingly, methods and equipment are sought that will increase the practicality and reduce the cost of the collection and transporting HCM for their commercial use.

PRIOR ART

It is known to heat heavy viscous hydrocarbons to improve their handling and enable transport of such material via pumping through lines and conduits. Such heating includes the use of RF frequencies. Bridges et al RE30,738 and U.S. Pat. No. 5,293,936 reveals a "triplate" arrangement of electrodes to heat a volume of oil shale or tar sands and gives design information for such an arrangement in U.S. Pat. No. 4,410,180. Bridges U.S. Pat. Nos. 8,210,256 and 8,408,294 also discloses a skin effect RF heater to heat the casing of an oil well and lower the viscosity of the oil.

Rowland U.S. Pat. Nos. 4,196,329 and 4,320,801 and Snow et al U.S. Pat. No. 9,777,564 reveal RF oil well heaters that radiate RF and heat the surrounding oil deposit. All of these various heating arrangements apply to extraction of hydrocarbonaceous materials using pumps located in stationary locations that cannot meet the needs of withdrawing HCM over large surface areas.

Accordingly, apparatus and methods are sought for heating HCMs at localized regions of HCM deposit that can heat HCMs in solid and semi-solid form over an entire volume of an HCM deposits. What is needed is a way to heat the viscous feed where it is intended to flow from within the tank or other HCM deposits into a pump suction line.

Readily relocatable apparatus and methods that can easily operate from place to place in an HCM deposit are also sought.

Apparatus and methods are also sought that can initiate heating of HCM in close proximity to a suction inlet that supplies HCM to a pump.

SUMMARY OF THE INVENTION

In its simplest feature this invention solves this problem with a heater that effectively heats viscous tar, asphalt, etc. at the entrance to a pump suction pipe.

In a more complete form this invention overcomes the above problems by using a suction line with a heating structure and a heating method that heats the HCM ahead of a suction line entrance without significantly impeding the flow of heated HCM into the suction line.

Described differently, this invention provides a method and equipment to draw HCM though a pump suction line and into a pump that discharges the HCM to a desired location such as a treatment facility or a loading terminal with an apparatus using a method that can readily and easily withdraw HCM from various areas over the surface of the HCM deposit.

This invention particularly benefits the removal of HCM material from an HCM deposit such as an asphalt pit with placement of the inlet heating structure that facilitates drawing HCM into the suction line and is positioned at a depth in the asphalt under the surface. In this position it may gradually drain the pit. However, should the drainage slow to an unacceptable level, for example by the encountering of any subsurface structure or highly refractory HCM, the inlet heating structure and associated suction line inlet are rapidly relocatable to new drainage location with better and renewed recovery potential.

In one aspect, this invention comprises an HCM extraction system for withdrawing highly viscous hydro-carbonaceous material (HCM) from multiple points in an HCM reservoir by immersion and, preferably, periodic movement of the inlet heater for the withdrawal of HCM and its subsequent transfer to desired locations. Preferably the inlet heater design facilitates sideways sweeping to withdraw heated HCM through its intake openings.

The invention similarly facilitates removal of HCM sludge (i.e. man-made HCM deposits) from the bottom of storage tanks. By arranging the inlet heater with a collector in the form of an extended conduit and by installing the inlet heating device to movably sweep through the volume of the sludge, the inlet heater locally heats the material to reduce its viscosity so that it may be pumped out of the tank. Preferably the sweeping moves the inlet heater in a direction perpendicular to a long axis of the collector to take advantage of inlets located along an extended length of the collector. Sweeping the heating device through the volume of the sludge clears it from the tank and restores the full volume of the tank for oil or other hydrocarbon storage.

In a further usage of the invention for desludging tanks, the heating device can utilize the wall of the tank as the ground part of the electric circuit in conjunction with the heating structure to soften corner deposits and remove the sludge by contact with the heating device and the drawing of heated sludge into the inlet of a pump suction line.

Thus, the invention can take various forms based on the type of HCM, the type of HCM deposit and the access to the deposit. The following description of the major aspects of the invention and their variation do not limit the invention to such specific details.

In another aspect this invention is an inlet heater for supplying highly viscous hydro-carbonaceous material (HCM) from a reservoir of HCM to a pump inlet and for transporting said HCM from one location to another. The inlet heater includes a collector for receiving heated HCM and an HCM outlet of the collector delivers heated HCM to a pump.

The collector is made of electrically conductive material and has one or more electrodes positioned in proximity to it. The collector includes an electrical contact for receiving an electrical current from a radiofrequency (RF) generator and preferably an input. However, the collector's electrical connection arrangement may return an electrical current to the RF generator. At least one electrode has electrical contact with the RF generator to also deliver or receive electrical current from the RF generator. Where one of the electrodes and collector receives RF electrical input and the other returns RF current, they can together complete an electrical circuit with the RF generator. The electrode(s) are spaced from the collector to define a space between them that heats HCM therein and/or thereabout when the RF generator delivers electrical current to or receives electrical current from the electrodes.

The HCM system includes a radiofrequency (RF) generator having a positive or exciter conductor for electrical connection to an electrically conductive portion of a collector conduit having an elongated central axis. The conduit defines an HCM inlet or inlets for drawing HCM into the conduit and an HCM outlet that delivers heated HCM to a pump suction line. The neutral or ground conductor of the RF generator communicates electrically with a plurality of rods that form a return electrical path for the generator and that extend longitudinally in line with the central axis of the conduit in a spaced apart relationship thereto to surround the conduit with a cage-like structure. An outlet end of the pump suction line communicates heated HCM to a pump inlet of a pump. The pump outlet discharges HCM from the pump to a desired location via a pump discharge line.

In a method aspect the invention recovers highly viscous hydro-carbonaceous material (HCM) from multiple points in a reservoir of HCM to a pump that pumps the recovered HCM to a desired location. The method heats the HCM in-situ in a reservoir of HCM with a radiofrequency (RF) generator that transmits electrical input to a collector and electrical current returns through one or more electrodes. The method of the invention requires at least submerging the collector into a reservoir of HCM with one or more electrodes spaced apart from but close enough to the collector so that RF fields between the collector and the electrodes heat the HCM in the space between them. The heat lowers the viscosity of the HCM in the volume of HCM located proximate the collector so that a pump pulls in HCM via a pump suction line having fluid communication with a collector outlet. The pump discharges HCM to a desired HCM delivery location via a discharge line.

In all aspects of the invention the HCM inlet(s) provide a permeable surface that by the size of the openings it provides and/or the area it covers will not unduly inhibit the inflow of HCM into the collector. In one embodiment the HCM inlets comprise a series of apertures and, in another embodiment, it comprises a screen sized to permit HCM flow therethrough while also rejecting contaminants comprising solid or semisolid debris.

All applications of the invention employ a radiofrequency (RF) generator having positive and neutral conductors for supplying electric input to the inlet heater wherein one conductor is in electrical communication with a central element of the inlet heater (e.g. collector conduit) and the other conductor is in electrical communication with the electrode electrical contact so as to form a return path for the electric current. The RF generator may comprise a separate component that operates in conjunction with the inlet heater. In a specific embodiment the RF generator comprises an integrated component of a complete intake assembly.

In another embodiment at least four electrode rods at least partially surround the elongated collector conduit portion with an at least semi-cage-like arrangement with the rods spaced circumferentially at least 30 degrees from each other. In other forms of this embodiment at least six rods completely surround the collector conduit portion in a cage-like arrangement.

In another embodiment the rods are eliminated from at least one side of the heater, so that when it is brought in close proximity to a corner of the grounded tank, RF fields between the tank wall and the collector heat HCM located in these corners so that this HCM may be drawn into the pump inlet to clean the tank.

In another aspect of the invention the inlet heater recovers HCM from a surface layer of HCM that comprises asphalt floating on a lake of water. The inlet heater heats the asphalt between a collector conduit and a cage of rods receiving RF input and the heated asphalt enters a permeable surface such as perforations located along the collector. The inlet heater is then pushed or pulled sideways by mechanical means, sweeping the layer of asphalt as it is heated into the collector and thence into the pump inlet. The rods are positioned so as not to impede the forcing of rigid asphalt by the sweeping motion into the space between the rods and the collector.

Another aspect of the invention incorporates a mixer within or about the intake assembly. The mixer can make use of solvents to aid in reducing the viscosity of the HCM by ensuring the solvent has sufficient contact with the HCM to make it effective. Preferably the mixer will form part of a collector within a cage-like structure of electrodes. An inlet heater that has a mixer typically includes piping and nozzles to discharge solvent in proximity to inlet heater and especially the mixer. The collector and/or the mixer may provide a suitable structure to retain the mixer in proximity to the intake assembly and to the HCM inlet. Preferably the mixer is incorporated into the collector.

Thus, this invention provides a practical apparatus and method for recovery of valuable HCM from geographically diverse locations and man-made storage locations. The invention does so by overcoming the previous difficulties that has restricted the use of HCM materials in a variety of useful applications.

The further description of this invention in the context of specific teachings and aspects that provide better understanding of its function and applicability does not imply any limitation on its applicability within the scope of the claims as hereinafter set forth.

DETAILED DESCRIPTION OF THE INVENTION

Figure 1:
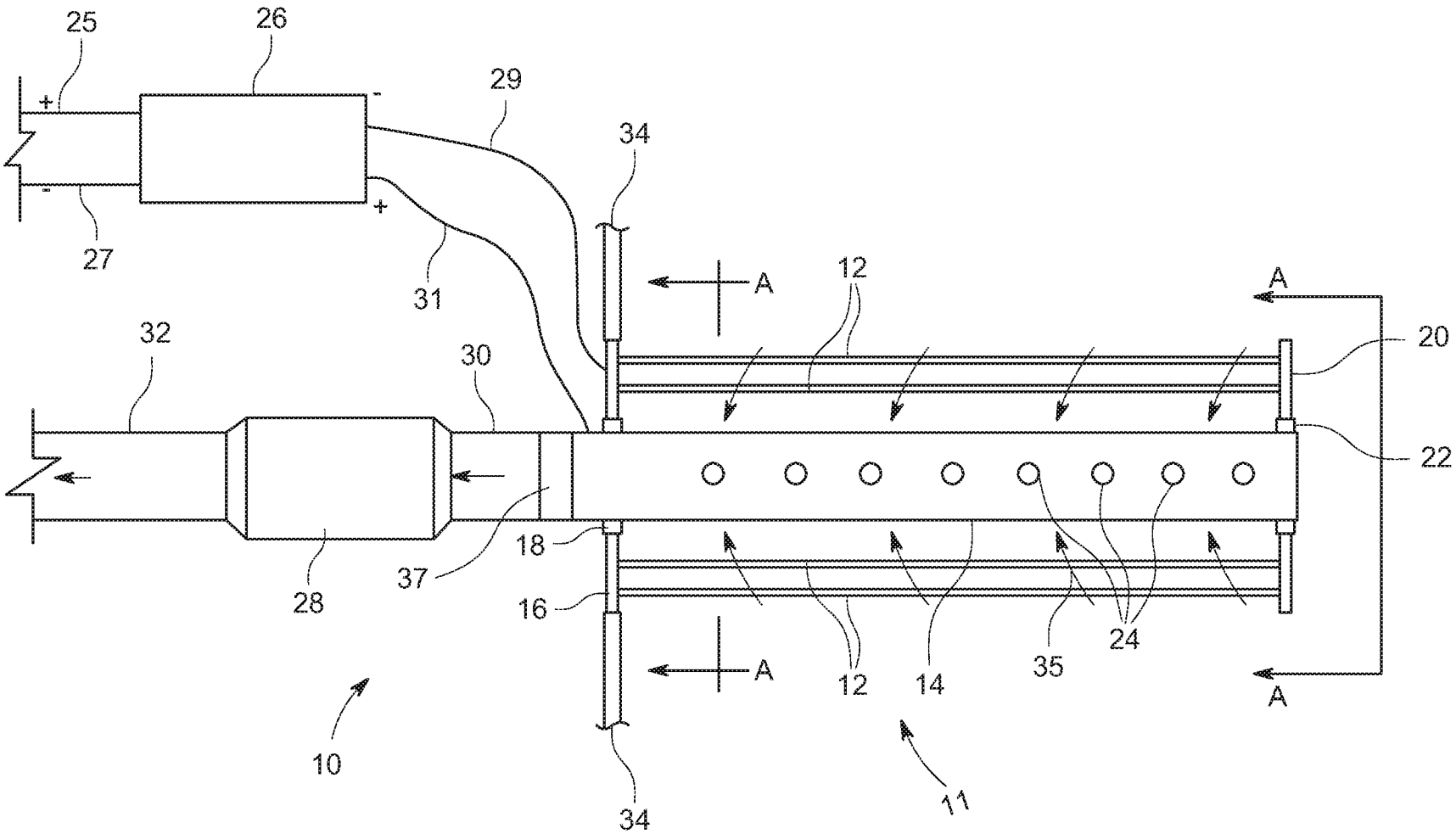
FIG. 1 is a sectional view of an inlet heater of this invention showing it in communication with a pump and receiving electrical input from an RF generator.

The further description of this invention in the context of specific teachings and aspects that provide better understanding of its function and applicability does not imply any limitation on its applicability within the scope of the claims as hereinafter set forth. All references cited herein are incorporated by reference in their entirety.

Definitions

The following terms have the following definition throughout the specification and claims.

The term HCM refers to all such heavy hydro-carbonaceous materials with a high enough viscosity to inhibit the practicality of their movement through a conduit by standard pumps used in refining and petrochemical applications without the incorporation of solvents or other viscosity reducing measures. The viscosity of HCM may range from 10 to 10,000 centipoise.

RF means radiofrequency power input from a radiofrequency (RF) generator.

Term about means a variation with respect to a given number equal to plus or minus 5%.

General Description

RF Heating Requirements

All aspects of the invention use a collector having an inlet for the inflow of HCM material, an HCM outlet from which a pump withdraws HCM material and at least one electrode spaced apart from the collector. A radiofrequency (RF) generator with RF electric fields in the megahertz region can volumetrically heat materials such as tar, and other HCM material in way similar to the operation of microwave ovens. RF waves can heat materials such as heavy oil primarily because such materials contain traces of dissolved water. Because of its high dielectric constant, water effectively absorbs RF energy even in small concentrations, e.g. less than one percent. In the absence of any water, HCMs still contain polar molecules such as chains with aromatic ends, or organic sulfur, oxygen and nitrogen compounds, which can absorb RF energy.

Thus, RF type heaters can heat HCMs to lower their viscosity. Such heating requires at least one pair of electrodes in a suitable configuration for immersion of at least one electrode into the HCM or to radiate RF energy into it. This invention configures such electrodes to produce heated HCM that flows into a pump suction line e.g. pipe, conduit, tube or hose.

Suitable RF generators can convert various sources of energy, such as 50 to 60-Hz electricity in single or 3 phase supply from a power company, generator using diesel or other fuel, or other mobile or fixed sources of electrical power. The RF generator preferably operates with the 3 phase power input to reduce power costs, especially when received from a power company.

Selection of Frequency

Designing an effective apparatus and method for heating HCM to clean oil tanks and recover HCMs from deposits for processing or use in substantially native form requires use of the proper frequency or frequencies for the application. Obtaining the proper frequency affects the selection of RF generating equipment, determination of its availability and evaluation of its cost for that frequency. Depending on the arrangement of the inlet heater the radiofrequency of the RF generator will be in a range of 500 Hz to 1 GHz.

Figure 8:
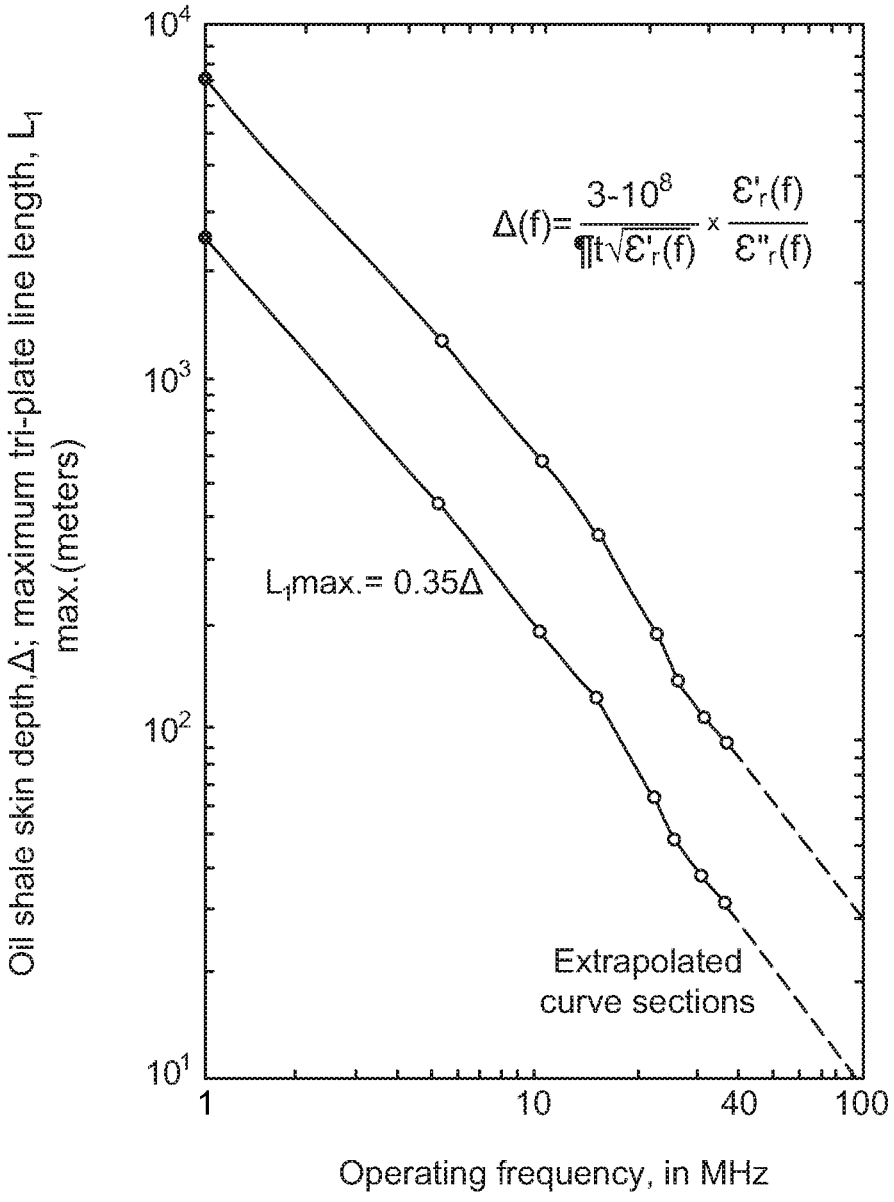
FIG. 8 is a graph from U.S. Pat. No. 4,140,180 showing operating frequency versus skin depth for shale oil recovery. (Note that in FIG. 7 the term "skin depth" means distance along the length of the heater.)

U.S. Pat. No. 4,140,180 (hereinafter '180) provides highly useful information related to the criteria affecting the design choice of RF heaters and particularly energy deposition in heater effectiveness. FIG. 8 (FIG. 10 as presented in '180) shows the "skin depth" vs frequency. Skin depth equates to energy deposition depth and (as noted above) refers to the length of heater over which the energy attenuation amounts to 1/e times the maximum input energy. Where e=2.78, this means that at the particular length the remaining energy is 1−1/e=0.65 and the deposition is 0.35. According to this reference, the frequency should be no more than the value that gives 35% attenuation over the length of the heater, so that all points along the length of the heater length will have heating rates not less than this amount. In FIG. 8 this length ranges from 10 to 30 m (30 to 91 ft.) at 100 MHz to 2,500 and 7,000 m (8,200 to 22,800 ft.) at 1 MHz. Therefore, this criterion provides an upper limit for frequency if a heater of particular length is desired to have uniform heating. If heating variation over the length is desirable, higher frequencies may be used. For example, in case of an inlet heater that includes the collector of this invention, varying the heating may prove beneficial in sweeping an axially extended collector in an arc around a cylindrical tank where the end of the collector sweeps more volume.

Furthermore, the voltage and current vary along the length in a sinusoidal way and with opposite phase. Providing electrical insulation (an open circuit) at the distal ends of the rods and collector of this invention assures a maximum voltage between the perforated conductor and the rods and maximum power dissipation in the material at this location. By making the length of the electrodes (the rods and collector) much shorter than a quarter wavelength, then voltage and frequency will vary less and the dissipation of power $I_2R$ along the length will be mostly uniform. At 6.8 MHz a quarter wavelength is 24 ft., so with 8 ft of length the heating will be reasonably uniform. At the proximate end the current will be sin(30∘)=71% of the maximum and the heating power will be $0.71_2$=50% of the maximum. It will be a maximum at the distal end. On the other hand, the frequency must be high enough to cause the HCM material between the electrodes (rods and collector) to effectively absorb the RF energy. The absorption of heating also depends on the dielectric properties of the material being heated. For the dimensions given in the example above, the frequency may be in the range of half to a few megahertz (MHz.) For example, the industrial and scientific (ISM) band 6.78 MHz may be used. As explained above, a lower frequency may be used if a higher voltage is acceptable. A computer model based on known electrical engineering principles solving the Maxwell equations can establish practical design conditions of frequency, power, voltage and amperage to assure that the material within the electrodes is heated effectively.

Figure 9:
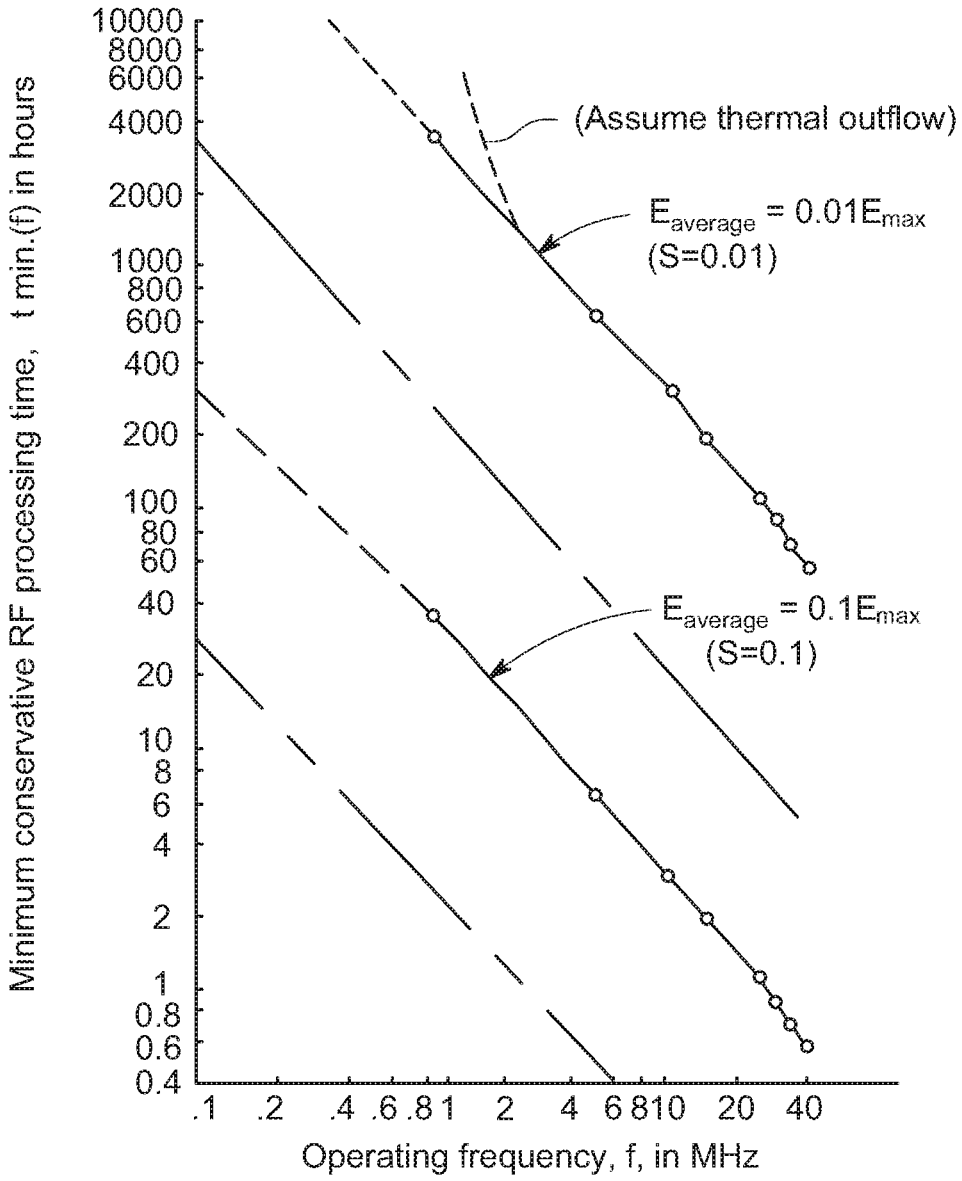
FIG. 9 is a graph from U.S. Pat. No. 4,140,180 showing operating frequency versus RF processing time.

A more convenient calculation method makes use of FIG. 9. The diagonal lines in FIG. 9 (FIG. 11 of U.S. Pat. No. 4,140,180) relate heating time (a measure of deposition rate) to frequency and voltage applied between the rods and the collector. (The curves have been displaced compared to the original in '108 because HCM can be mobilized by heating to 70° C. or less, while oil shale requires 500° C.) The lower curve assumes that the voltage may be 100,000 v/m of spacing between rods and conduit to prevent arcing between them, while the upper curve assumes only 10,000 v/m.

In FIG. 9 the intersection of a diagonal line with the frequency on the abscissa allows the heating time to be read from the vertical axis. The lower curve shows that 0.5 minutes of heating would be required by applying the higher voltage, and the upper curve shows 1 day. This is the time required to heat the volume of HCM situated within the inlet heater. For an inlet heater where the spacing between the central conduit and the rods is 8 inches or 0.2 m these voltages would be multiplied by a factor of 0.2 to get the same voltage difference per meter spacing and the safe voltage would be 2000 to 20,000 v.

Thus, the RF generator must deliver the required power to the inlet heater assembly at a chosen frequency. MHz frequencies require a vacuum tube generator, while the preferred solid state generators currently have an upper limit of 400 KHz. At 400 KHz the lower curve requires 1.5 hr heating, while the upper curve requires 3 weeks. To use the higher voltage of the lower curve may require a step-up transformer. Otherwise a slower rate may require the inlet heater to be built with a larger volume.

The impedance of the inlet heater assembly must match the impedance of the generator for an effective transfer of power. The matching is accomplished by a circuit including a transformer and capacitors as in known in the art. Alternatively the matching may be done with a stub tuner connected to the distal end of the inlet heater assembly, or to the coaxial cable leading from the RF generator to the inlet heater.

The rate of heating in terms of bbl/hr is determined by the heating time as calculated above multiplied by the volume of the inlet heater, depending on its length and diameter. The rate depends on the required temperature rise to reach a pumpable viscosity. Honey typically has a viscosity of 2000 centipoise (cp) and is pumpable. Typically, the viscosity of heavy oil is reduced an order of magnitude for each 15° C. heating. Therefor an HCM with viscosity 100,000 cp will be reduced to 1000 cp by 30° C. heating.

The rate also is determined by the capacity of the RF generator to deliver power to the inlet heater. The rate from a particular generator capacity can be determined by a heat balance. For example, a 100 KW generator can heat at the following rate:

$$\frac{100{,}000\ \text{w}}{1} \times \frac{\text{BTU}}{\text{hr } 0.293\ \text{w}} \times \frac{\text{lb °F.}}{0.44\ \text{BTU}} \times \frac{5°\ \text{C.}}{9°\ \text{F.}} \times \frac{bb1}{350\ \text{lb}} \times \frac{1}{30°\ \text{C.}} = 35.9\ \text{bbl/hr}$$

This production rate can be achieved with an inlet heater containing a volume of 35.9 bbl HCM by heating in one hour. If more than an hour is required, the inlet heater can be made larger to achieve the same production rate. And the time depends on the voltage applied as explained above.

Detailed Description of Preferred Embodiments

Specific forms of the inlet heater and intake assembly of this invention are set forth in conjunction with the referenced figures. The figures use like reference numbers in referring to like elements described in these embodiments. The components and arrangements described in these specific embodiments only describe a few of the many possible variations by which this invention may be practiced.

Figure 2:
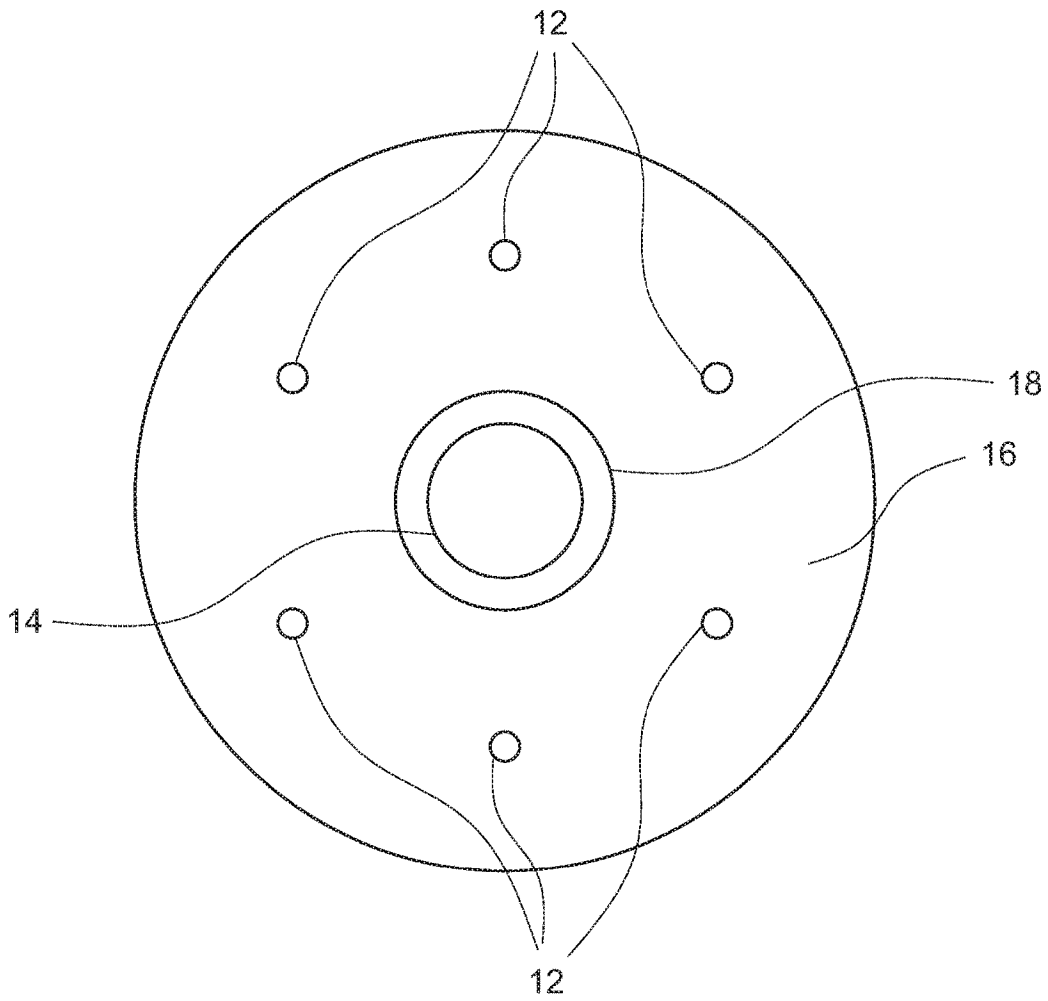
FIG. 2 is a view of the of the distal end of A-A of FIG. 1.

FIGS. 1 and 2 show an embodiment of a complete HCM intake assembly 10 The complete intake assembly includes an inlet heater 11 comprising an array of electrodes in the form of conductive rods 12 surrounding a collector defined by a conduit 14, a pump suction line, a pump and an RF generator.

Looking then at the inlet heater, FIG. 1 provides a sectional view taken down the principal axis of the inlet heater and a schematic representation of the other intake assembly components and FIG. 2 represents a complete cross section of the inlet heater taken at A-A. Rods 12 create a cage-like structure around conduit 14. An electrically conductive support plate 16 at the proximate end of intake assembly 10 retains rods 12 in an orientation that axially extends the rods in line with the axis of conduit 14. Support plate 16 also retains conduit 14 using a non-conductive support ring 18. In lieu of a ring, any type of ligament having sufficient electrical resistance to prevent significant electrical conduction between the electrode and the collector may secure rods 12 to conduit 14.

FIGS. 1 and 2 show the ends of rods 12 typically extending from plate 16 to distal support plate 20 that supports the distal ends of rods 12. Likewise, conduit 14 extends from plate 16 to support plate 20. In preferred form support plate 20 provides electrical communication between rods 12 and conduit 14 and a return path for the current. In a less preferred arrangement, an optional non-conductive support ring 22 may prevent electrical communication between rods 12 and conduit 14. An alternate arrangement may eliminate support plate 20 so that the rods and conduit extend freely from a proximate plate in cantilever fashion. In this case the rods and conduit have no electrical communication.

Rods 12 may comprise any electrically conductive material that has sufficient strength to prevent excessive deflection of the rods 12, whether cantilevered or supported at both ends, when contacting the HCM and/or other objects or structures within or about the HCM. Suitable rod materials include metals such as aluminum or copper, or steel, but can use other materials. Preferably the rods can additionally be heated through a skin effect electric resistance so that the resulting heating of the rods helps the rods penetrate the HCM material prior to its heating by the RF fields.

In FIG. 1 an RF generator 26 receives power through a pair of leads 25 and 27 to generate RF output to positive conductor 31 and neutral conductor 29 that transmit power to conduit 14 and rods 12 respectively. The neutral and positive conductor may be alternated if desired. Support plate 18 electrically connects rods 12 to neutral (or ground) RF output 29. Energy from the resulting RF field heats HCM in proximity to the rods and conduit. The presence of lossy HCM components that absorb RF energy causes the heating of the HCM. The heated HCM flows past the rods in the direction of arrows 35 and into a permeable surface of conduit 14 defined by apertures 24. A pump 28, joined to the conduit 14 by an electrically insulating connector 37, draws the HCM in the form of heated viscous oil into and through conduit 14 and a pump suction line 30. Alternatively, the material of suction line 30 may comprise electrically insulating hose such as high-temperature resistant silicone rubber reinforced with glass fiber or other resilient and durable material in which case insulating connector 37 is unnecessary. Pump 28 discharges the viscous oil through a discharge conduit 32. The discharge conduit typically delivers the HCM to transport or treating facilities as previously described.

HCM intake assembly 10 may be used in a variety of ways. It may be temporarily installed in a tank and arranged to move therein or permanently installed by attachment to a wall section 34 of a tank using appropriate electrical insulation between the tank wall and the conductors. The intake assembly 10 can also be mobile for deposition into a tar pit or other HCM deposit. The location of wall section 34 approximates the typical depth of insertion for inlet heater 11 into a natural HCM deposit. Again, rods 12 may supply additional heat to the HCM by methods such as resistive electrical heating where helpful to initially sink the intake assembly into an HCM deposit. Alternatively, the suction line may be connected to the neutral generator terminal. Then the electrode rods will be connected to the positive terminal, but they must be insulated from the grounded tank walls.

Figure 3:
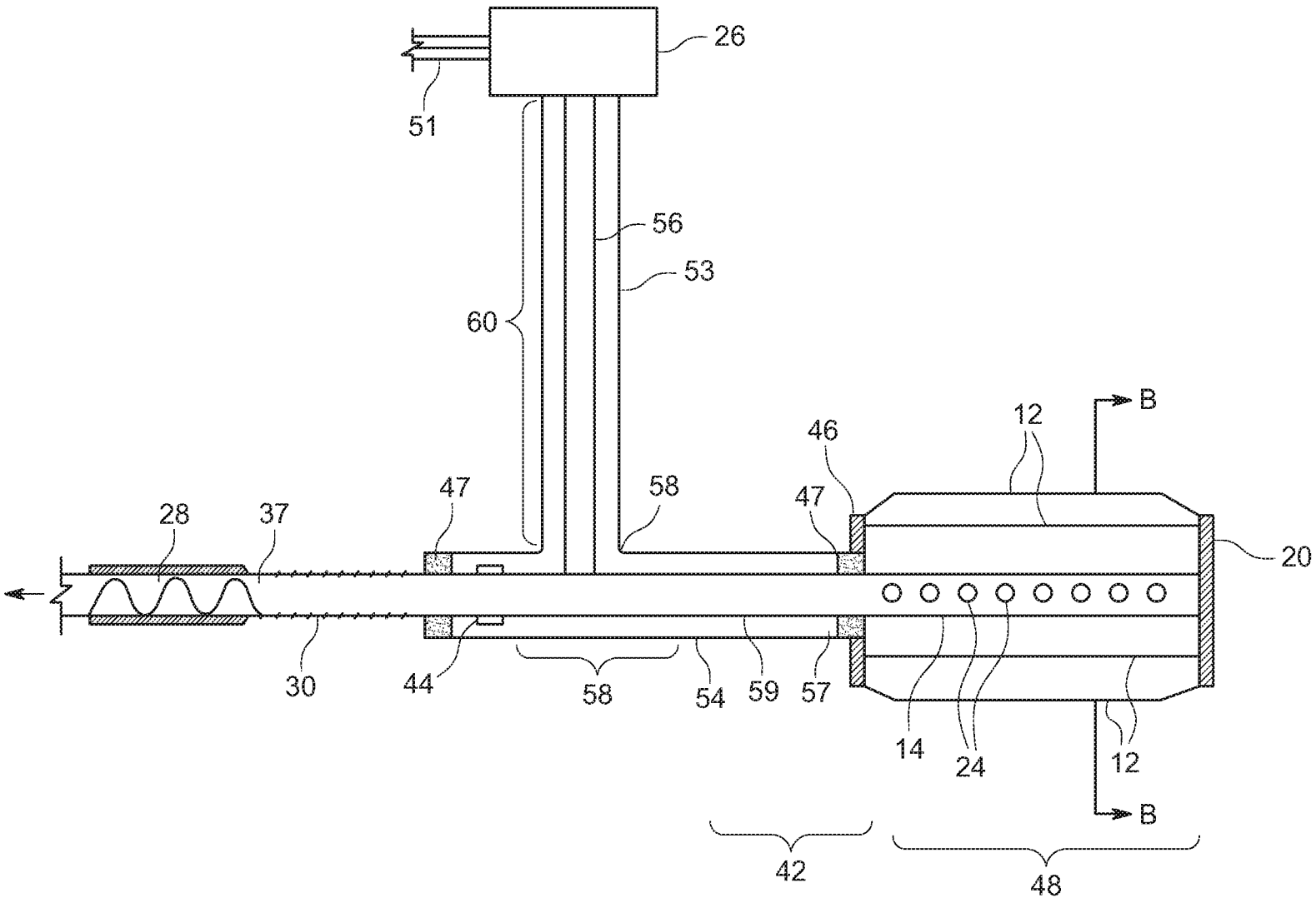
FIG. 3 shows a variation of the inlet heater and the intake assembly of FIG. 1.
Figure 4:
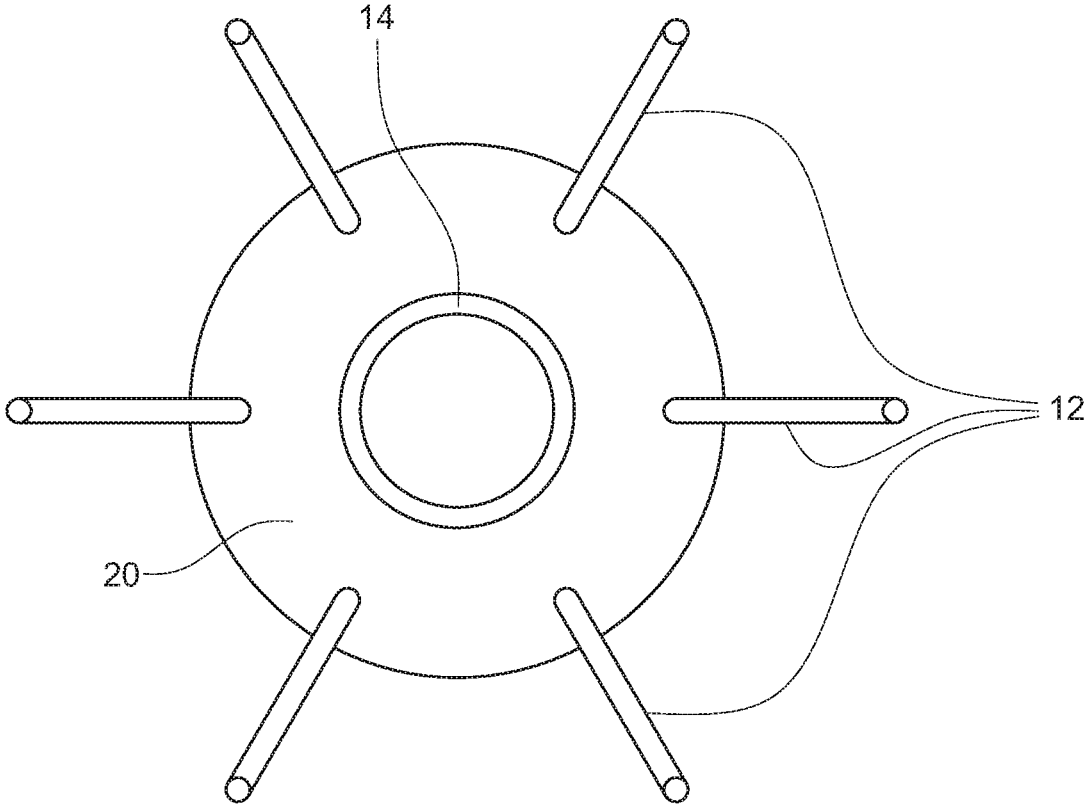
FIG. 4 is a section of the inlet heater taken at B-B of FIG. 3.

FIGS. 3 and 4 present another embodiment in two views similar to FIGS. 1 and 2 wherein FIG. 3 provides a sectional view taken down the principal axis of the inlet heater and a schematic representation of the other intake assembly components and FIG. 4 represents a complete cross section of the inlet heater taken at section B-B. In this embodiment an inlet heater 48 can be integrated into a complete mobile intake assembly 42 that collectively provides an independent coaxial system to heat HCM for intake into conduit 14. Conduit 14 serves as the collector of inlet heater 48 and rods 12 create a cage-like structure 48 that completely surrounds conduit 14. An electrically conductive support ring 46 retains rods 12 in an electrically conductive connection at the proximate end of heater 48 that, together with electrically conductive distal support ring 50, holds rods 12 in general axial alignment with conduit 14. Ring 50 preferably comprises conductive material for electrical shorting between rods 12 and conduit 14.

Rather than using wires, the output of the generator 26 may take the form of a coaxial cable 60 comprising an outer neutral or ground conductor 53 and an inner, positive, exciter, tubular conductor 56. This cable forms a T-connection 58 with a similar cable in the form of conduit 59 that provides a tubular extension of the conduit 14 and an outer shield 54. Conduit 14 together with an outer shield 54 provide positive and neutral connections to the inlet heater assembly 48. Shield 54 and conduit 59 may have a composition of a highly conductive material with sufficient thickness and strength to physically support the inlet heater 48 while conducting RF power to the inlet heater. The collector tube 14 communicates openly with conduit 59, so that HCM may flow from the collector down the conduit 59 toward an inlet 37 of a pump 28. One or more insulating rings 47 support the conduit 59 within shield 54 and seal gap 57 between the exterior of conduit 59 and shield 54 to prevent HCM from entering gap 57, thus preventing dissipation of power into HCM that may otherwise enter this gap. The rods 12 of the collector may be directly attached to the shield 54 or may be connected to the shield through a conductive ring 46 that can provide greater strength to the attachment point of rods 12. At the distal end of inlet heater 48 rods 12 may connect directly to the distal end of the collector tube 14 or rods 12 may connect with collector 14 though a metallic ring 50. To the left of T-connection 58 the conduit 59 transitions to an electrically insulating conduit 30 at a connector 44 to transport heated HCM to the pump. Optionally the shield 54 may extend to the left of T connection 58 by a distance equal to a quarter wavelength to form a waveguide beyond the cutoff that prevents radiation of RF into the surroundings.

FIG. 3 also schematically shows an RF generator 26 that receives a 3-phase power input via supply leads 51 and provides RF output to coaxial cable 60. The cable transmits power to conduit 14 through conduits 56 and 59 and returns power through rods 12, shield 54, and ground conductor 53 of coaxial cable 60 in the manner previously described.

Heating of HCM within the cage formed by rods 12 reduces its viscosity and facilitates flow through apertures 24, collector 14, conduit 59 and into pump 28 for delivery to a desired location via discharge line 32 as previously described.

In a variation of the embodiment depicted by FIG. 3, the conduit 59 may be heated by a skin effect if desired by choosing appropriate metallic compositions. Providing multiple pairs of RF inputs and returns would allow variations in the RF heating in different portions of the inlet heater and associated parts of the inlet assembly. For example, having one pair of RF electrical input and return conductors that provide RF heating using conduit 14 and rods 12 and using another pair of RF input and return conductors to provide heat via shield 54 and conduit 56 would enable a different level or type of RF input to each of these regions.

Figure 5:
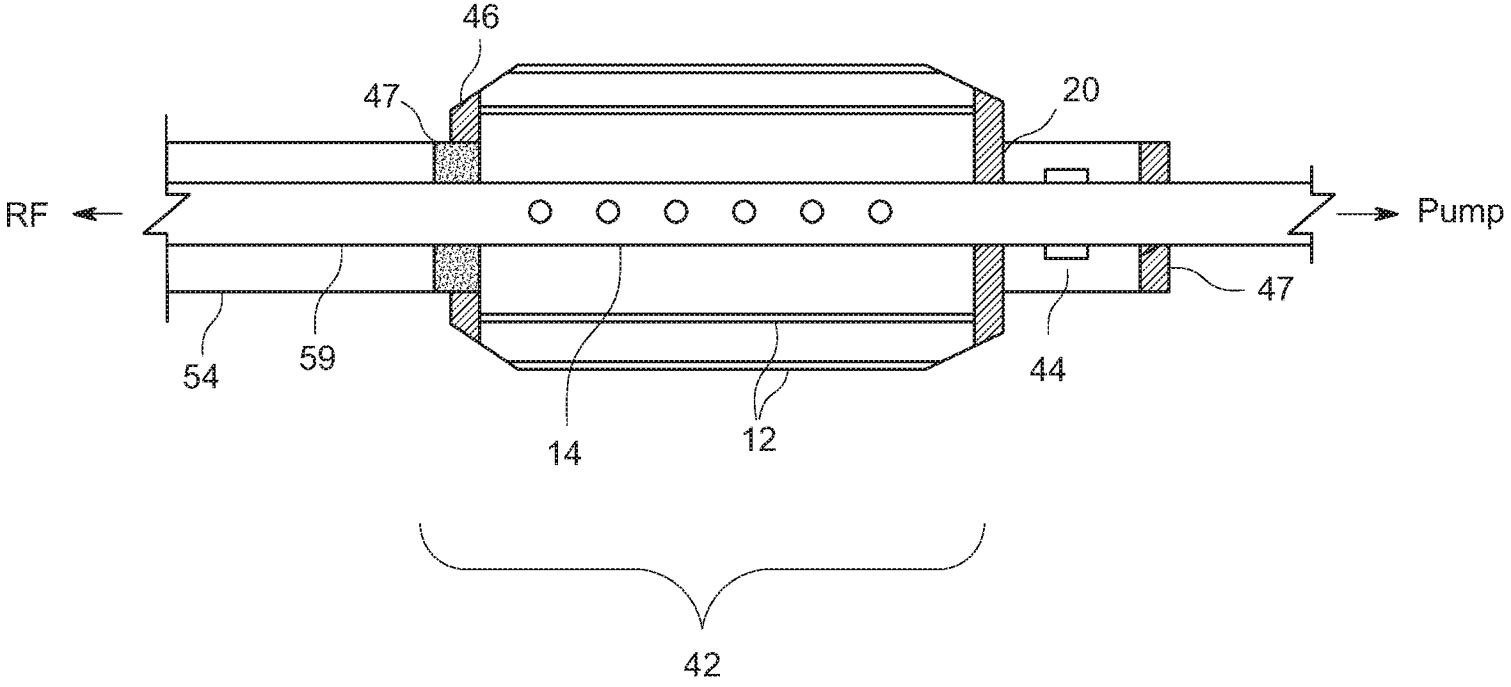
FIG. 5 shows an alternate embodiment where the RF connection is at one end of the inlet heater and the pump is at the other.

Other variations of the embodiment depicted by FIG. 3 involve the positioning of the RF coaxial cable 60 relative to the pump inlet conduit 30. In one such variation (not shown) the coaxial cable may be interchanged with the pump conduit so that the RF conduit leads are in line with conduit 24 and the pump conduit 30 is positioned as the side arm. In another variation shown in FIG. 5, the RF coaxial cable 60 is attached to one end of the inlet heater, while the pump inlet conduit is separately attached to the other end.

Figure 6:
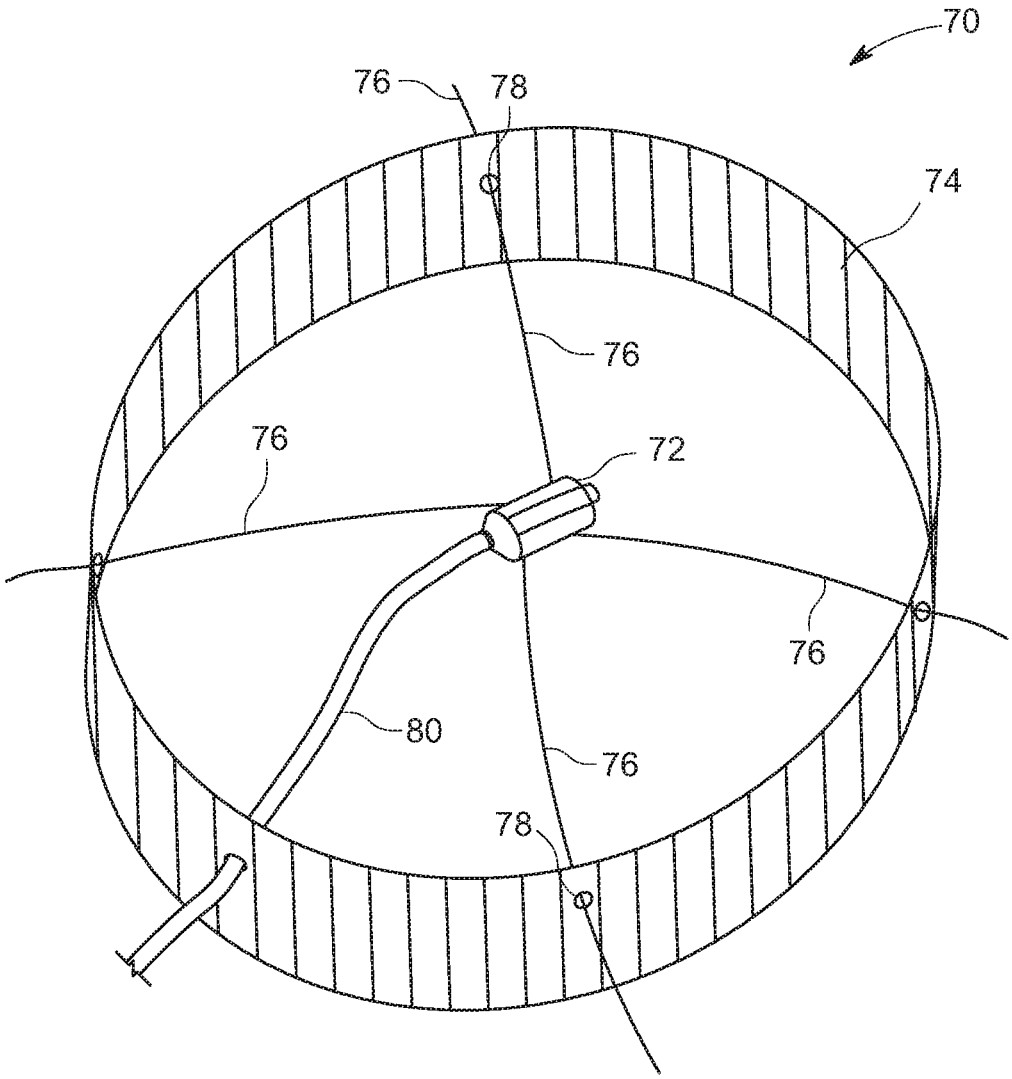
FIG. 6 shows a cable arrangement for moving an inlet heater about the inside of a storage tank.

FIG. 6 depicts a useful embodiment for tank cleaning using the inlet heater. Sweeping the inlet heater around the inside of the tank allows it to act as a vacuum cleaner that melts and removes heavy oil materials such as sludge. A system of cables 76, as shown in FIG. 6, overcomes the problem of limited access to the inside of the tank. Cables 76 control the location of inlet heater 72 (shown schematically) to pull it over an entire area of the depicted horizontal segment 74 of a storage tank. FIG. 6 shows cables 76 operating from access holes 78 in the sides of tank segment 74.

In a modification of this arrangement the cables can extend from the terminal ends of conduits that extend into the tank about its periphery (not shown) to locate positions for pulling the cables and controlling the horizontal location of the inlet heater within the tank. Moreover, raising or lowering of such conduits to vertically adjust the cable pulling points can enable locating of the inlet heater anywhere within the volume of the tank and avoid potential problems associated with perforations through the tank wall. A suction line in the form of a coaxial cable can bring RF power to the heater and withdraw heated HCM from the tank.

When the inlet heater is used in a tarpit or the large diameter tank, it may be desirable to provide a method to keep it floating near the surface of the tar or sludge. For this purpose, floatation tanks may be attached at both ends of the inlet heater and sized to provide enough buoyancy to support the weight of the inlet heater. The tanks may be arranged so that the inlet heater floats just below the surface of the HCM.

Figure 10:
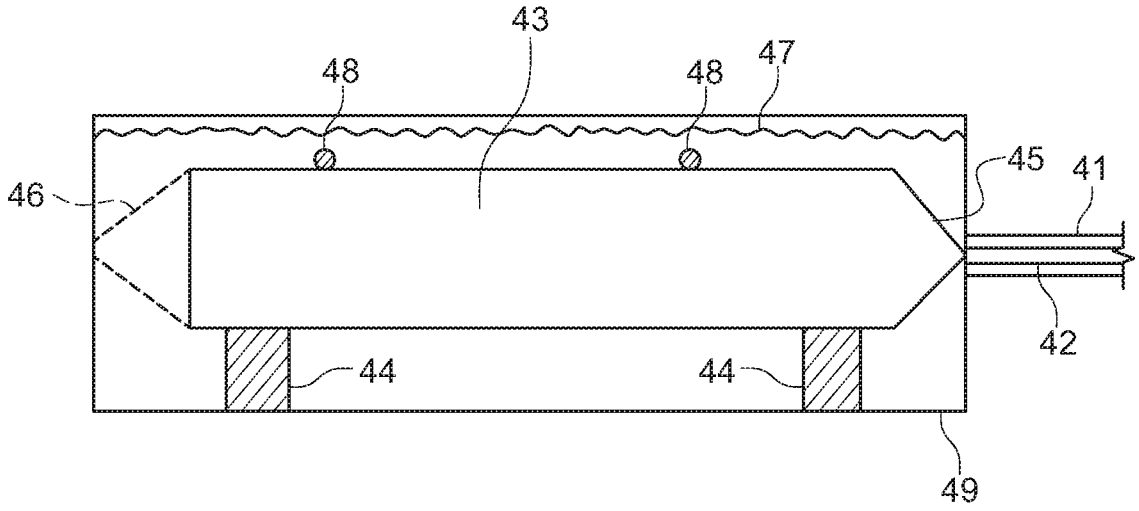
FIG. 10 shows the interior of a box that contains a single electrode in the shape of a blade.
Figure 11:
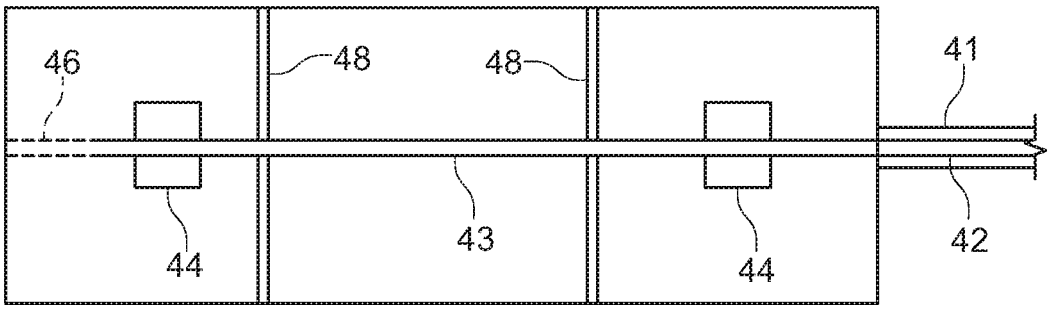
FIG. 11 is a top view of the single blade electrode located in the box.

In another embodiment the HCM may be contained in a tank or container small enough to be heated as a unit. In this case the electrodes need not sweep the volume but may be fixed in position so that the entire contents of the container are heated at once. For example, FIGS. 10 and 11 show a container in the form of box 49 with a single electrode in the shape of a blade 43. Alternatively, the electrode may comprise a planar electrode array formed by a row of electrically conductive bars (not shown). At one end the electrode is connected to the central conduit 42 of a coax cable 41 leading from the positive terminal of an RF generator (not shown) through the proximate end of box 49. The coax cable shield 41 leading from the neutral terminal of the RF generator is connected to the box 49. In this arrangement the walls of the box serve as the electrode. RF fields radiate from the electrode through the HCM to the wall of box 49 thereby heating the HCM. The distal end of end of the box may remain open (i.e. no conductive contact with box 49) or it may be electrically connected to the distal end of box 49 in a short circuit as explained previously. Once the HCM in box 49 is heated it may be pumped out of the box. An additional batch of HCM may be inserted into box 49 or the emptied box may be used to store other material such as crude oil.

Again, FIGS. 10 and 11 show side and top views of the blade 43 and its arrangement. The blade may be in the form of a flat conductive plate or the row of electrode rods (not shown) as previously described. At the proximate end of box 49 the central conduit 42 of the coax cable connects the blade 42 (the electrode) to the positive terminal of an RF generator (not shown) through and through a flared transition section 45 that widens to the width of blade 43. The shield of the coax cable connects the metal of box 49 to the neutral terminal of the RF generator. Inside box 49 blade 43 rests on blocks 44 which are made of ceramic or other non-conductive material. Horizontal non-conducting rods 48 retain blade 43 in an upright position. At its distal end blade 43 be shored to box 49 through a flared transition section 46 that narrows from the width of blade 43 to a truncated point in direct electrical contact with box 49. HCM typically fills the container, in this case box 49, to a surface level 47. Suitable containers may for example be a standard 20 ft shipping container or a cylindrical tank housing an electrode that extends in a horizontal plane as opposed to a vertical plane as shown for blade 43.

Example 1-5, Removal of HCM from Tank or Pit

Example 1

The following is an example to calculate the production rate required for a given size of inlet heater when used to remove HCM from a tank or a pit. The length of the inlet heater is chosen to fit inside the given diameter of the tank or provided with a convenient length to deploy in a tar pit. In the case of an inlet heater with a cage-like arrangement of rods, the overall cage diameter is chosen so that the volume between the rods and the collector will heat HCM at the rate needed to satisfy the desired pumping rate of the withdrawn HCM. For example, the heater may be 8 ft. long, and may be 4 in. to 3 or more ft. in diameter. The collector conduit may be similar in diameter to the pump inlet, for example 2.4 in. For an 8 ft. long inlet heater with a collector conduit diameter of 2.4 in. and an 8 in. diameter of the cage formed by the rod bundle, the volume of material heated between the rods and the pipe is 4.9 $ft^3$ or 0.9 bbl. In the sample calculation given above an RF generator may be designed to heat HCM by 30° C. at a rate of 35.9 bbl/hr, which should lower viscosity to make the HCM pumpable. Thus, using 100 KW power from the generator this example heats the volume of HCM in the heater structure in 0.9/35.9 hr or 1.5 minutes and requires nearly the highest voltage that is allowed. It also indicates that the movement of the heater may sweep this much HCM into the heater in 1.5 minutes.

Example 2

If the heater dimensions are increased, the movement may be less. A 50 ft. long heater could heat the heater volume in 9.3 minutes. It could sweep the entire 45,000 bbl contents inside of a 200 ft. diameter 8 ft. sludge depth tank in 45000/35.9 hr or 1.7 months assuming passes at multiple levels.

Example 3

Alternatively practice of the invention may employ higher frequency generators that typically have vacuum tubes. Such generators can provide frequencies as high 1 MHz and could reduce the heating time from 1.7 months to 0.5 months. The reduction in time will need balancing against the higher generator cost of such generators and the lower reliability of vacuum tubes. Such generators may be cost effective in heating small volumes of heavy materials where power requirements are low.

Example 4

Larger rates may be obtained by increasing the size of the cage like structure provided by the rods surrounding the collector and/or by increasing the input power. In such cases a 50 ft. long inlet heater could sweep the entire inside of a 200 ft. diameter tank in 600 hr or 25 days with two passes at 2 levels.

Inlet Heater with Integral Mixer

Figure 7:
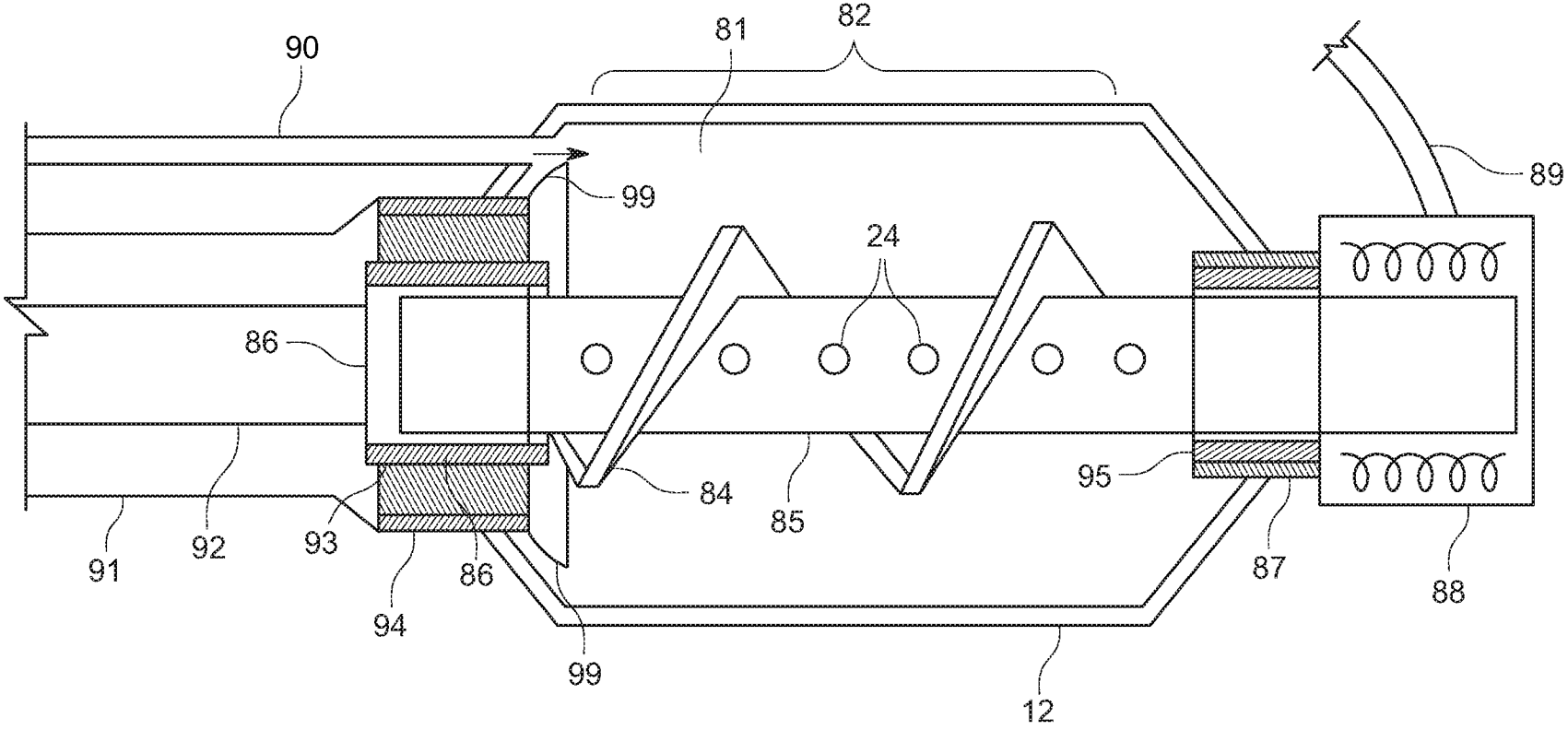
FIG. 7 shows an intake assembly with a mixer incorporated therein.

FIG. 7 illustrates an embodiment of the invention that fixes a mixer 81 to an inlet heater 82 to mix HCM ahead of the inlets 24 by which the HCM enters a collector in the form of collection conduit 85. In most cases the mixing takes place in the presence of a solvent that can reduce the viscosity of, i.e. soften, the HCM in addition to heating. The use of solvents to reduce highly viscous hydrocarbons is known, however solvents typically fail to achieve this end. Usually the solvent doesn't mix with the viscous hydrocarbon and remains in a separate phase. Mixing can overcome this problem.

Although FIG. 7 illustrates a preferred mixing arrangement where the collection conduit 85 provides the active mixing element, inlet heater 82 may incorporate any type of mixing elements that provide significant blending of the solvent with the HCM. Other suitable mixing arrangements include driven mixers with rotatable shafts that operate apart from conduit 85 and static mixers.

Looking then at the preferred mixing arrangement of FIG. 7, mixer 82 uses collection conduit 85 as the barrel of a screw type mixer about which a series of screw flights 84 extend in a spiral arrangement. Although FIG. 7 illustrates a screw flight around the perimeter of conduit 85, conduit 85 may use other protruding elements or structures such as blades, fins or rods to shear the HCM and effect mixing of solvent and HCM. The screw flight or other mixing elements are preferably made of non-conducting material such as plastic so that it does not affect the RF fields within the structure. While not preferred, metallic mixing structures may be used, and such materials may be attached to conduit 85 by welding or integral forming on conduit 85.

A conductive ring 94 surrounds a non-conductive spacer 93 that in turn surrounds a proximate bearing 86. At the opposite end of inlet heater 82 a conductive sleeve 87 surrounds a distal bearing 95. Bearings 86 and 95 rotatably retain opposite ends of conduit 85. Sleeve 87 also supports a motor 88. Under electrical power from a pair of power leads 89, motor 88 supplies torque to rotate conduit 85. The motor typically operates on a standard power source such as 50 to 60 Hz current, but suitable motors may operate on any available power source. FIG. 7 depicts an optional embodiment wherein the distal end of conduit 85 extends past distal bearing 95 to provide the armature of motor 88 and directly drive the rotation of conduit 85.

A pump suction line 92 provides conduction of RF current with conduit 85 and an outer shield 91 provides conduction of RF current with ring 94 wherein suction line 92 and shield 91 provide a coaxial transmission of electrical RF inputs or input and return to inlet heater 82. RF heating occurs within a cage-like structure, formed around conduit 85 by rods 12 as previously described. Conductive sleeve 87 secures the distal ends of rods 12 and conductive ring 94 secures the proximate end of rods 12 to electrically connect the RF generator with rods 12. Suction line 92 has electrical communication with the RF generator and with conduit 85 via conductive bearing 86 that insures electrical conduction between suction line 92 and conduit 85. For this reason, bearing 86 typically comprises a highly conductive material. Conductive bearing 86 also inhibits HCM leakage through any space between the proximate end of conduit 85 and distal end of suction line 92 as conduit 85 delivers heated HCM to suction line 92.

The addition of solvent via a solvent tube 90 can further soften the HCM. Tube 90 can be attached to the mixer in any suitable way that delivers solvent through its outlet to a desired location. Preferably the positioning discharges solvent inside the space between rods 12 and conduit 85 (i.e. into the cage-like structure) and more preferably such that the solvent reaches the screw flight or other mixing element. Typically, the solvent addition varies with the amount of heat input. Solvent may be used with no heat addition to the inlet mixer 81. Solvent softened HCM enters the inlets 24 and flows through conduit 85 and pump suction line 92 to a pump in a manner analogous to that shown in FIG. 1 or FIG. 3.

In the case where the solvent or lighter oil is floating on an expanse of heavier material (e.g. HCM) the mixer 81 can be positioned at the interface between the different hydrocarbonaceous materials and preferably across the interface, so that screw flight 84 or other mixing structures churn the solvent into the heavier material. Preferably, the solvent and HCM are simultaneously heated by the heater. Or the mixer can be used without turning on the heater where most suitable in particular cases. The now-thinner mixture again flows to a pump as previously described.

In operation the motor applies torque to its armature (e.g. the distally extended portion of conduit 85) and causes the screw to turn and stir the material within the cage structure created by rods 12. As described previously, the bearings are preferably made of conductive metal, and the conduit 85 is in electrical contact with the bearings 86 and 95 even as it rotates within them. Preferably bearing 95 electrically connects the two RF sources at the distal end of rods 12.

Solvent introduced through tube 28 into the mixing zone lowers the viscosity of the HCM as described below. The lower viscosity aids in the flow of HCM into the apertures 24 of the conduit 85.

As an optional feature a cowl 99 may be fixed at the proximate end of the heater and preferably within the confines of the electrode(s.) Preferably a non-rotating part such as ring 94 retains cowl 99 at the proximate end of inlet heater 48. Preferably cowl 99 is made of non-conducting material so that it does not affect the RF fields within the structure. When turning the screw flight in a direction that pushes HCM toward the proximate end of mixer 81, cowl 99 may prevent the HCM from flowing out of the zone defined by rods 12 and may urge HCM into inlets 24 near the proximate end of mixer 81. This feature may provide advantages whether using a mixing arrangement with or without solvent addition.

Example 5—Removal with Solvent Addition

In this calculated example an HCM with an initial viscosity of 100,000 cp can be reduced by an order of magnitude to 10,000 cp by mixing diluent into the HCM in the amount as herein determined. Diluents that may be used to lower viscosity of HCM include naphtha fractions refined from crude oil, having a viscosity similar to that of diesel fuel, i.e. a viscosity near 3.5 cp. An approximate formula for the viscosity of a mixture is the Gambil rule (www.neutrium.com):

$$\nu^{1/3}=x_a\nu_a^{1/3}+x_b\nu_b^{1/3}$$

where ν=viscosity, x=mol fraction, subscripts a and b refer to the HCM and the diluent respectively. Substituting $\nu_b=1-x_a$ and solving, $x_a=(\nu^{1/3}-\nu_b^{1/3})/(\nu_a^{1/3}-\nu_b^{1/3})$ and $x_b=1-x_a$.

For a general case we assume that the HCM molecular weight is 4 times that of diesel fuel. Lowering the viscosity of HCM from 100,000 to 10,000 requires a solvent content of 24 wt %, with the remaining 76 wt % being HCM. To lower viscosity two orders of magnitude from 100,000 to 1,000 requires 52% solvent and 48% HCM. A particular HCM-solvent mixture is called dilbit and is made of Canadian bitumen and solvent which contains about 35 wt % solvent. Thus, any solvent can help lower viscosity, but a large proportion of solvent is required to lower viscosity by orders of magnitude.

Using solvent with viscosity lower than 3.5 is of little help, because calculation shows that the recovery results are essentially the same. Furthermore, such lighter solvents have a higher vapor pressure and may produce a combustible vapor mixture in the tank. Nitrogen addition to the vapor space in the tank lowers the combustible limit.

On the other hand, raising the temperature by 30° C. lowers viscosity two orders of magnitude, and is achievable with the heater. While in most cases heating alone will be practical, a combination of heating and solvent mixing may have advantages in some situations. For example, the added solvent makes the heated mixture, upon cooling, more stable when heat is lost during further transport. And with the addition of the previously described cowl, the mixer may push HCM into the pump inlet at a rate that allows the pump to work on HCM with less heating and only a partly reduced viscosity.

Recovery of Asphaltic Material from Tar Lakes

HCM may come from any of the sources described in the background of the invention or such other sources as generally fit the herein given descriptions and definition of HCMs. A particularly useful application of the invention applies to HCM deposits where the tar or other such viscous material floats on a layer on water, such as Guanoco Lake as previously described.

In application of this invention to removing HCM from a tar pit or lake having a thick layer of asphalt or other HCM the intake assembly provides an intake heater with a heating element as described for positioning below the surface of such deposit. The collector of the input assembly gradually drains the material as the pump pulls in HCM from the collector. In such applications the inlet heater may be modified to draw it sideways into the layer and heat the HCM material that is drawn into the heater elements and that act on material drawn into the opening defined by the collector of the inlet heater. In this manner heated product enters the through perforations in the central collector pipe.

REFERENCES

| Patents | | |
|---|---|---|
| 4,196,329 | April 1980 | Rowland |
| 4,320,801 | March 1982 | Rowland |
| 4,140,180 | February 1979 | Bridges et al |
| RE30738 | September 1981 | Bridges |
| 5,293,936 | March 1994 | Bridges |
| 8,210,256 | July 2012 | Bridges |
| 8,408,294 | April 2013 | Bridges |
| 9,777,564 | October 2017 | Snow |

The invention claimed is:

1. A pump inlet heater suitable to be embedded in a volume of highly viscous material capable of absorbing radiofrequency (RF) energy to reduce its viscosity so that it can be drawn by suction into the pump inlet, the heater structure comprising a central perforated conduit that is at least in part electrically conductive, the perforated conduit having proximate and distal ends and connected at the proximate end to the inlet, the perforated conduit is surrounded by a cage of at least two electrically conductive rods spaced at least 30 degrees apart and having proximate and distal ends;

and an electric circuit including an RF generator having positive and neutral terminals, and the perforated conduit connected at its proximate end to the positive or neutral terminal of the generator, the rods connected at their proximate end to the other terminal, the rods fixed with respect to each other and supported at their proximate and distal ends by electrically conductive support rings which in turn are supported by electrically insulating ligaments attached to the perforated conduit, so that current flowing along the rods and perforated conduit radiate fields to dielectrically heat the material enclosed between the rods and perforated conduit so that the viscosity of heated material is suitably reduced to flow through the perforations into the perforated conduit to the pump inlet.

2. The inlet heater of claim 1 wherein the heater is located in a tank or vessel, and a portion of the perforated conduit is connected to the pump inlet through a flexible suction line, and a cable system acts on the heater to move it through the volume of material, so that it removes material from different regions of the tank.

3. The inlet heater of claim 1 where the generator supplies energy at a frequency such that the structure is shorter than a quarter wavelength.

4. The inlet heater of claim 1 wherein the pump inlet heater is suitable for reclaiming viscous material from inaccessible regions such as corners within a tank or vessel, where the tank is made of electrically conductive material, and the tank as well as the rods are connected to the neutral terminal of the generator, so that the tank wall partially replaces some of the rods and the electric field heats the material enclosed between the wall and rods and the perforated conduit.

5. The inlet heater of claim 1 wherein the inlet heater further comprises a mixing zone with at least one mixing element positioned to contact material before it enters the perforated conduit, wherein the mixer comprises a rotatable portion of the perforated conduit with protruding elements and a motor element positioned to impart rotation to the mixer portion of the perforated conduit, with bearings fitted between the support ligaments and the perforated conduit to allow rotation of the mixer portion of the perforated conduit with respect to the rods.

6. The inlet heater of claim 1 where provision is made to inject solvent into the mixing zone.

7. A tank heater suitable for heating at least part of the volume of highly viscous material contained within a tank comprising a storage vessel, wherein the tank is constructed of an electrically conductive material, the heater comprising a central electrode in the form of an extended thin plate or blade spanning at least a portion of the tank, and the walls of the tank provide the other, ground electrode, and the plate is electrically connected at one end to the positive terminal of an RF generator, and the wall is connected to the neutral terminal of the RF generator so that the plate provides surface area to radiate fields between the electrode and walls suitable to heat at least a portion of the viscous material within the tank.

8. A method of increasing the rate of pumping of a volume of highly viscous material by dielectrically heating the material to reduce its viscosity before it enters a pump, by feeding the inlet of the pump with the viscous material through a perforated inlet conduit and surrounding the perforated conduit with a cage of electrode rods, and submerging the cage in the viscous material; and connecting the cage and perforated conduit to the terminals of an RF generator so that current flows to one of the cage or perforated conduit and returns through the other of the cage or the perforated conduit, to establish an electric field between the cage and the perforated conduit that heats the material contained between them.

9. The method of claim 8 wherein a storage tank holds the highly viscous material, the RF generator electrifies at least a portion of the of a storage tank wall to provide the electrode, perforated conduit is located near the wall of the tank and together with the electrode heats the viscous material to reduce its viscosity and the pump withdraws heated viscous material through the perforated conduit from a volume of viscous material proximate the perforated conduit.

10. The method of claim 9 wherein the viscous material receives heating as it passes through a pump suction line that connects the perforated conduit with the pump inlet.

* * * * *